United States Patent [19]

Horne

[11] 4,237,191

[45] Dec. 2, 1980

[54] BONDED ROAD STUDS

[75] Inventor: John M. Horne, Yatton, England

[73] Assignee: Berger Traffic Markings Ltd., Bristol, England

[21] Appl. No.: 933,037

[22] Filed: Aug. 11, 1978

[30] Foreign Application Priority Data

Aug. 23, 1977 [GB] United Kingdom ..... 35338/77

[51] Int. Cl.[2] ..... G08G 1/00

[52] U.S. Cl. ..... 428/542; 404/16

[58] Field of Search ..... 404/15, 16; 428/542

[56] References Cited

U.S. PATENT DOCUMENTS

| | | | |
|---|---|---|---|
| 2,256,636 | 9/1941 | Abbott | 404/16 |
| 3,409,344 | 11/1968 | Balint et al. | 404/14 X |
| 3,485,148 | 12/1969 | Heenan | 404/16 X |
| 3,758,191 | 9/1973 | Hedgewick | 404/16 X |
| 3,822,158 | 7/1974 | Hoffman et al. | 404/16 X |
| 3,936,208 | 2/1976 | Baynes et al. | 404/16 |

*Primary Examiner*—Henry F. Epstein

*Attorney, Agent, or Firm*—Wenderoth, Lind & Ponack

[57] ABSTRACT

A non-depressible bonded road stud is rectangular in plan and comprises a body portion having a substantially flat upper face and four substantially upright side faces sloping downwardly from the side edges of the upper face onto a basal plinth portion. The basal plinth extends laterally away from the lower edges of the upright side faces of the body portion on all sides thereof and has an upper surface sloping outwardly and downwardly away from the periphery of the body portion. Two opposite upright side faces of the body portion are fitted with reflecting lenses and the upper surfaces of the plinth adjacent the lens-carrying side faces of the body portion comprise ridges which are substantially centered with respect to the side faces and the said upper surfaces are cambered to slope away from both sides of the ridges. The plan area of the road stud is at least 70% greater than the plan area bounded by the periphery of the body portion and the average thickness of the basal plinth is substantially 10% to 20% of the maximum thickness of the stud.

8 Claims, 3 Drawing Figures

BONDED ROAD STUDS

This invention relates to bonded road studs.

The use of road studs, and in particular reflecting road studs, in order to warn, guide or inform road users is well known. More recently reflecting non-depressible road studs which are bonded to the road surface, rather than anchored within the road surface, have been gaining favour. Such studs, manufactured in a plastics material, have been found to comply with relevant requirements.

A bonded, reflecting non-depressible road stud is adhesively bonded to the road surface. Asphalt or coated macadam is a road material in common use, and suitable adhesives for bonding studs to the surface of a road of such material, as well as to concrete roads, have been developed. The preferred technique of laying such studs is to apply a layer of adhesive, which may be based on epoxide resin, to the road surface and press the stud firmly into the adhesive so that adhesive is squeezed out around the sides of the stud to form a seal around the edge, the stud being bedded in the layer of adhesive.

Both the epoxide adhesive and asphalt or coated macadam road materials are thermoplastic in nature, and therefore have a tendency to soften when heated. During a hot summer, road surface temperatures of 130° F. or more can be encountered. It has been found that the softening which the adhesive and the road material undergo when road surface temperatures of this level are reached, can result in the road traffic passing over the studs impacting the studs into the road surface, with subsequent break-up of the adhesive bond and detachment of the studs.

It is an object of this invention accordingly to provide an improved road stud which is less subject to detachment from the road surface under extreme temperature conditions.

The present invention proposes accordingly to provide a non-depressible bonded road stud which comprises an upstanding body portion and a basal plinth portion extending laterally away from the periphery of the body portion on all sides thereof.

The provision of the basal plinth enlarges the effective surface area of the stud for bonding to the road surface and results in loads applied externally to the stud being distributed over a greater area of the road surface so lessening the degree of penetration of the stud into a thermoplastic road surface which has become softened due to the effects of extreme ambient temperatures. This advantageous effect arises because of the reduction in load per unit area at the stud/road surface interface due to the provision of the basal plinth which increases the base area of the stud at the interface.

The road stud may be of monolithic or composite construction. A composite construction may provide a relatively thin rolled outer skin or shell construction the interior of which is filled with a suitable filler material. However, the plinth is preferably comprised by a base flange integral with a body portion of the road stud, although it may be initially formed separately and thereafter bonded to the body portion of the stud. The body portion of the stud preferably includes reflectors which may be of any suitable type as bi-convex lenses or cube-corner reflecting elements. The upper surface of the road stud is preferably uneven, to confer skid resistance.

The road stud may be constructed of a suitable plastic material, natural or synthetic rubber.

A road stud embodying features of the invention is shown by way of example in the accompanying drawings, in which.

Figure 1:
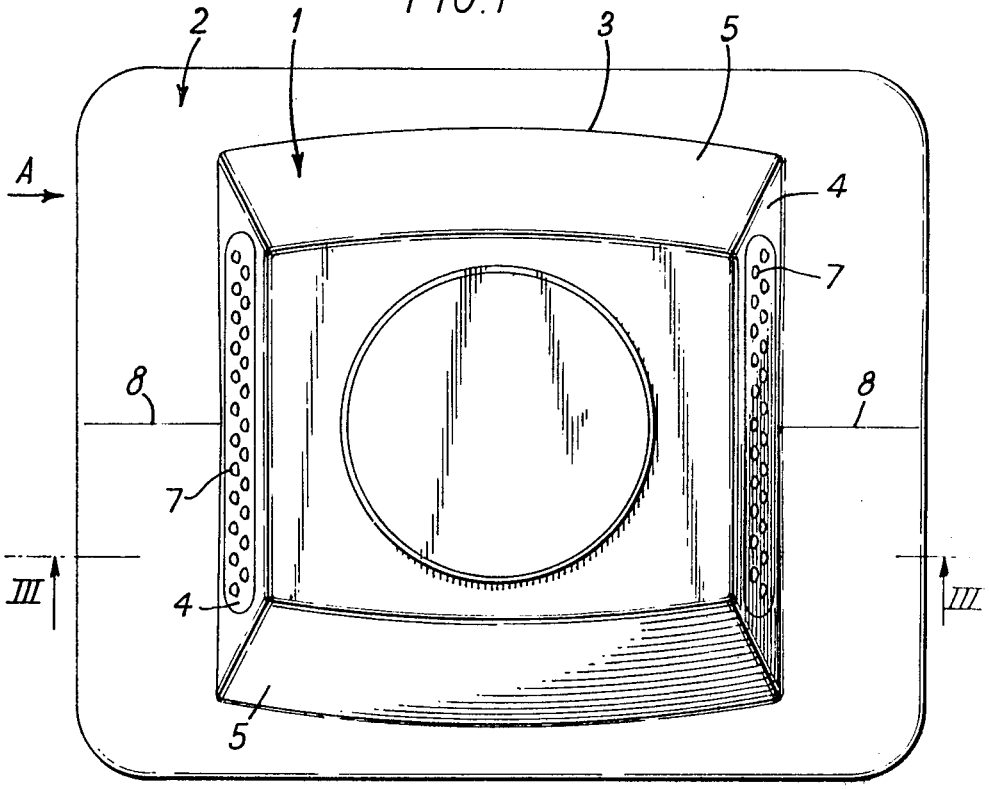
FIG. 1 is a plan view of a bonded, reflecting non-depressible road stud in accordance with the invention.

Referring to the drawings, the road stud shown, which may be integrally moulded from acrylonitrile butadiene styrene copolymer, comprises an upstanding body portion 1 and a basal plinth portion 2. The body portion 1 comprises the portion of the stud within the peripheral or boundary line 3, and the plinth 2 surrounds the body portion 1 on all sides and extends laterally away from the periphery 3 thereof.

The outer boundary of the road stud is substantially rectangular in plan, whereas the body portion 1 is substantially square and is centered on the plinth 2. The central body portion 1 has opposite pairs of substantially upright side faces 4 and 5 and an upper substantially flat face 6. All edges and corners of the upper surfaces of the road stud are rounded so as not to present any sharp edges to road traffic and at least the upper face 6 may be superficially roughened, for example by being imprinted.

Two opposite side faces 4 of the stud main body portion 1 are provided with reflecting lenses 7 which are permanently sealed into the body of the stud. Two rows of reflecting lenses are shown, but more or fewer could be provided.

Figure 2:
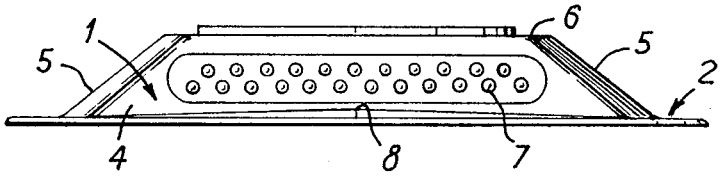
FIG. 2 is a side view of the road stud taken in the direction of the arrow A in FIG. 1.
Figure 3:
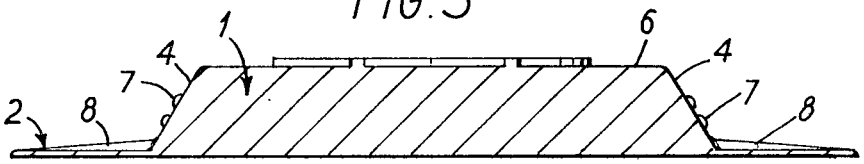
FIG. 3 is a cross-section taken on the line III—III in FIG. 1.

The upper surface of the plinth 2 slopes outwardly and downwardly away from its line of juncture with the main body portion 1 at the periphery 3 to allow rain water and mud to run off. In addition, the upper surfaces of the plinth adjacent the lens-carrying faces 4 are cambered to fall away sideways as well as outwardly, see particularly FIGS. 2 and 3, from respective high points or ridges 8 substantially centered with respect to the faces 4. This provides an additional "lead-in" for road traffic running over the stud and also improves drainage from the faces 4, particularly under adverse weather conditions, and thus assists in preventing soiling of the lenses 6.

Typical dimensions of the improved road stud shown and described are as follows:

Overall dimensions of the stud in plan—140 mm × 120 mm.

Overall thickness (height) of stud—17 mm.

Average thickness of plinth 2–1.75 mm, rising to 3.5 mm at the ridges 8.

In comparison with a conventional road stud having overall dimensions substantially that of the main body portion within the boundary 3 of approximately 101 mm × 98 mm, the exemplary improved road stud according to the invention shown and described has a surface area for bonding to the road surface approximately 70% greater. Impact tests made with the improved road stud shown and described in comparison with the aforesaid conventional stud to assess the penetration characteristics of both studs into a thermoplastic material by measuring the depth to which both road studs penetrate the material at the same temperatures and loads have shown that the ratio of the depth of penetration of the improved road stud into a thermoplastic medium to the depth of penetration of the conventional road stud is of the order of 1:4, and there is evidence to show that this ratio will increase over an extended period of use.

It will be appreciated that the improved road stud according to the invention may be designed in other ways from that specifically described and illustrated and still fall within the scope of the appended claims.

I claim:

1. A non-depressible bonded road stud which comprises an upstanding body portion including two opposite substantially upright side faces which are fitted with reflecting lenses, a basal plinth portion extending laterally away from the periphery of the body portion on all sides thereof and including an upper surface which slopes outwardly and downwardly away from the periphery of the body portion; and wherein the upper surfaces of the plinth adjacent the lens-carrying side faces of the body portion comprise ridges which are substantially centred with respect to the side faces and the said upper surfaces are cambered to slope away from both sides of the ridges.

2. A road stud according to claim 1, which comprises a composite construction.

3. A road stud according to claim 1, which is moulded from a plastic material or natural or synthetic rubber.

4. A road stud according to claim 3, which is integrally moulded from an acrylonitrile butadiene styrene copolymer.

5. A road stud according to claim 1, wherein the upper surface of the body portion is substantially flat.

6. A road stud according to claim 5, wherein the upper surface is superficially roughened.

7. A road stud according to claim 1, wherein the plan area of the road stud is at least 70% greater than the plan area bounded by the periphery of the body portion.

8. A road stud according to claim 1, wherein the average thickness of the basal plinth is substantially 10% to 20% of the maximum thickness of the stud.

* * * * *